US006343994B1

(12) United States Patent
Clarke

(10) Patent No.: US 6,343,994 B1
(45) Date of Patent: Feb. 5, 2002

(54) LOW-PROFILE INFANT SWING ASSEMBLY

(76) Inventor: William A. Clarke, 4549 Budd Dr., Erie, PA (US) 16506

( * ) Notice: Subject to any disclaimer, the term of this patent is extended or adjusted under 35 U.S.C. 154(b) by 0 days.

(21) Appl. No.: 09/772,232

(22) Filed: Jan. 29, 2001

(51) Int. Cl.[7] ..... A63G 9/16
(52) U.S. Cl. ..... 472/119; 472/118; 5/108; 297/273
(58) Field of Search ..... 472/118, 119, 472/125; 5/108, 109, 105; 297/273, 274

(56) References Cited

U.S. PATENT DOCUMENTS 3,261,032 A * 7/1966 Reardon ..... 5/108
3,842,450 A * 10/1974 Pad ..... 5/109
4,970,740 A * 11/1990 Crawford ..... 5/109
5,342,113 A * 8/1994 Wu ..... 297/260
5,487,705 A * 1/1996 Clarke ..... 472/29
5,562,548 A * 10/1996 Pinch et al. ..... 472/119
5,660,430 A * 8/1997 Clarke ..... 297/230
5,791,999 A * 8/1998 Lauro et al. ..... 472/118
5,846,136 A * 12/1998 Wu ..... 472/119

* cited by examiner

*Primary Examiner*—Kien T. Nguyen
(74) *Attorney, Agent, or Firm*—Richard K. Thomson

(57) ABSTRACT

A swing assembly suitable for children ages new borne through 12 months has a seat member that surrounds the child, and a disk-shaped base with support legs extending upwardly therefrom. The width of the base exceeds the vertical extent of the swing assembly making it extremely stable. The base includes a stationary base that supports a rotational base to permit turning throughout 360° about a vertical axis. The swing may be oscillated by manual and/or mechanized members. The dimensions of the swing are such that it can be easily maneuvered around, moved about and transported to other locations.

12 Claims, 6 Drawing Sheets

LOW-PROFILE INFANT SWING ASSEMBLY

BACKGROUND AND SUMMARY OF THE INVENTION

The present invention is directed to a baby swing. More particularly, the present invention is directed to a low-profile swing that is safe for infants, ages new born to twelve months.

In the past several years, numerous law suits arising from infant injuries and fatalities have resulted in recalls of conventional baby swings and reduced the number of manufacturers of such swings from about a dozen to only a few. Indeed, the financial burden of those burgeoning law suits threatens to force the remaining manufacturers to discontinue production of their swing product lines.

Even apart from the threat of injuries, conventional baby swings had numerous other problems. The long skinny legs that made the swing so unstable, also made it difficult to maneuver, a risk for tripping passers by, and problematic for taking along (i.e., this swing design did not fit easily into a car). Further, the swing could not easily, nor safely, be moved from place to place while the baby was seated therein. Therefore, movement of the swing during use would require two persons: one to hold the baby, one to move the swing.

Coupled with the safety issues associated with walkers and bouncers, there are very few, if any, devices that parents can safely use to occupy their children. Further, most all of these devices are unsuitable for use with new born children or any child younger than 3–4 months old whose neck is incapable of supporting the weight of its own head.

The present invention overcomes the problems with these prior art baby swings. The present invention comprises a low-profile swing for infants including a base member, support legs extending upward from the base member, a seat for an infant rotationally supported by the legs, and means for oscillating the seat relative to the base and the legs, allowing the infant to be safely swung without fear of tipping. The base is a disk-shaped element whose maximum lateral dimension exceeds the maximum vertical extent of the support legs. This configuration provides an extremely stable configuration that cannot readily be tipped over. The seat completely surrounds the child while supporting the infant in a semi-reclined position and is, therefore, suitable for infants from new born through 12 months of age. Optionally, the seat may be removed from the support legs and double as a layette or car seat. The base member includes a stationary base element and a rotational base element so that the orientation of the swing may be readily changed to provide the infant with a change of scenery. Further, the stationary base may be provided with casters so that the swing may be easily moved without the necessity of removing the child. Since the child's legs do not extend outside the confines of the seat member, the seat may be mounted within a few inches of the base enhancing the stability of the swing assembly. Lastly, the relatively compact construction and light weight of this swing enable a mom to easily pick up the swing to transport it to another room or load it into a car to enable its use during a visit.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 6:
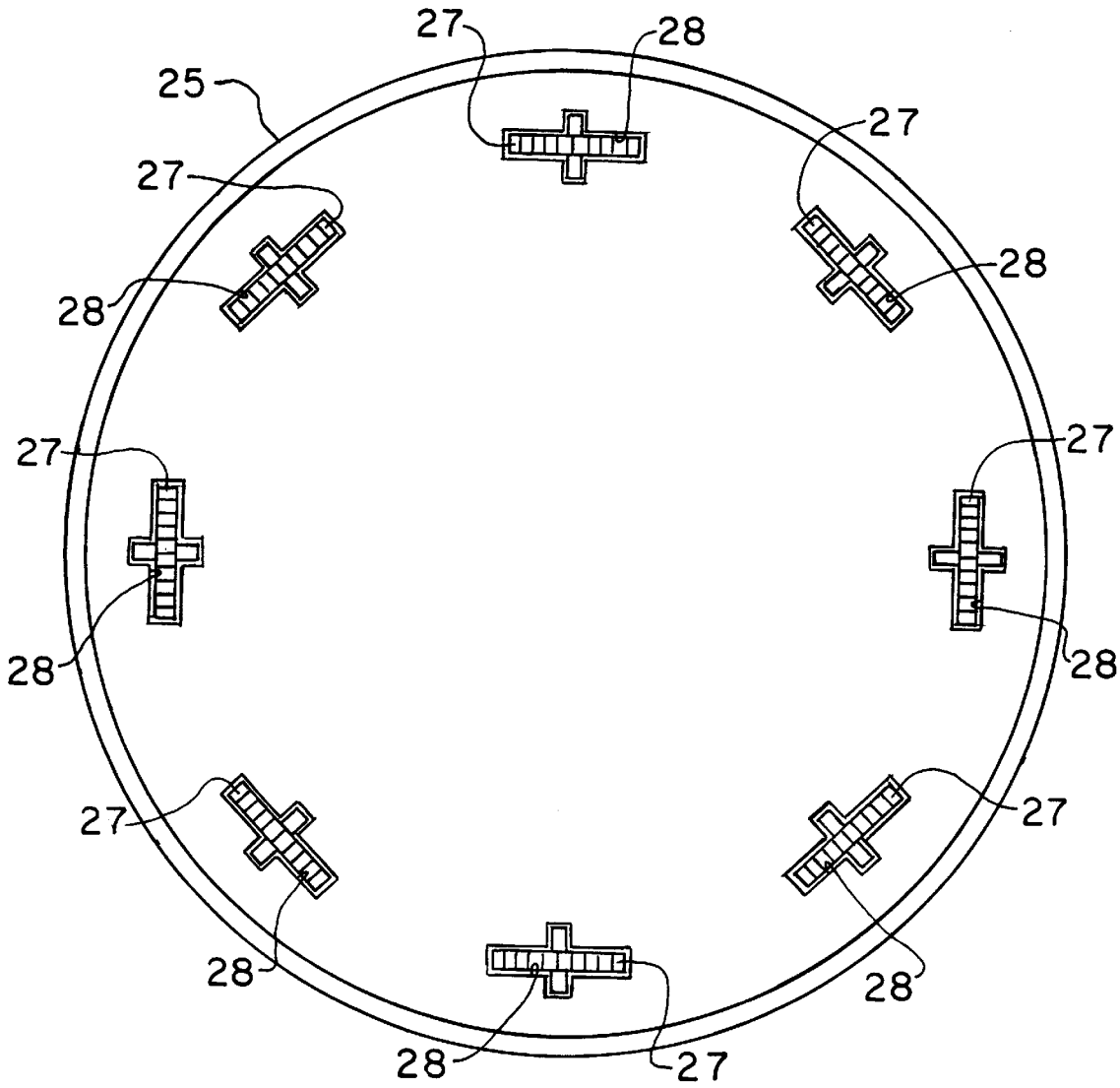
FIG. 6 is a top view of the stationary base with the rotational base removed.

A first preferred embodiment of the low-profile swing assembly of the present invention is shown in FIGS. 1–5 generally at 20. Low-profile swing assembly 20 includes a disk-shaped base member 22 and two legs 30, 32 which extend generally vertically from an upper face thereof. Base member 22 includes a stationary base 25 and a rotational base 26 supported thereon by wheels 27 that are received in molded recesses 28 (FIG. 6). Rotational base 26 has a stepped configuration, center portion 23 being raised to provide room for the upper halves of wheels 27. Rotational base 26 can be turned throughout a 360° arc relative to stationary base 25 to provide the infant with a change of visibility (both what it sees and where it can be seen from). Casters 29 are preferably provided beneath stationary base 25 (FIGS. 2–4) to facilitate its movement from place to place, but may be omitted to save manufacturing cost without significantly impacting the utility of the device. Base member 22 is extremely stable: even with a 200 lb man standing on the edge of base 22, it will not tip over.

Figures 1, 1A:
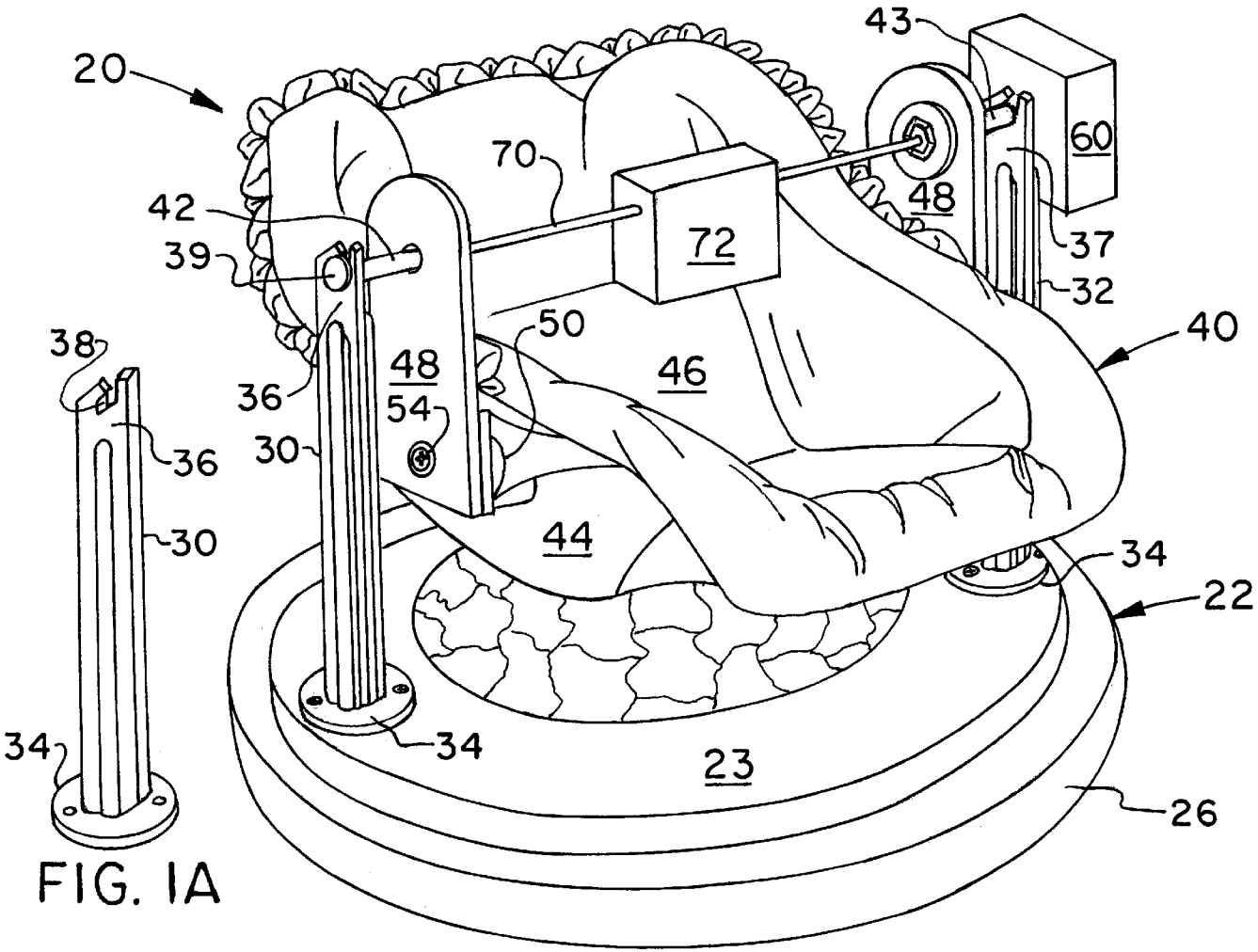
FIG. 1 is a perspective view of a first preferred embodiment of the low-profile swing of the present invention.
FIG. 1A is a perspective view of the leg showing the details of the receiving slot.
Figure 2:
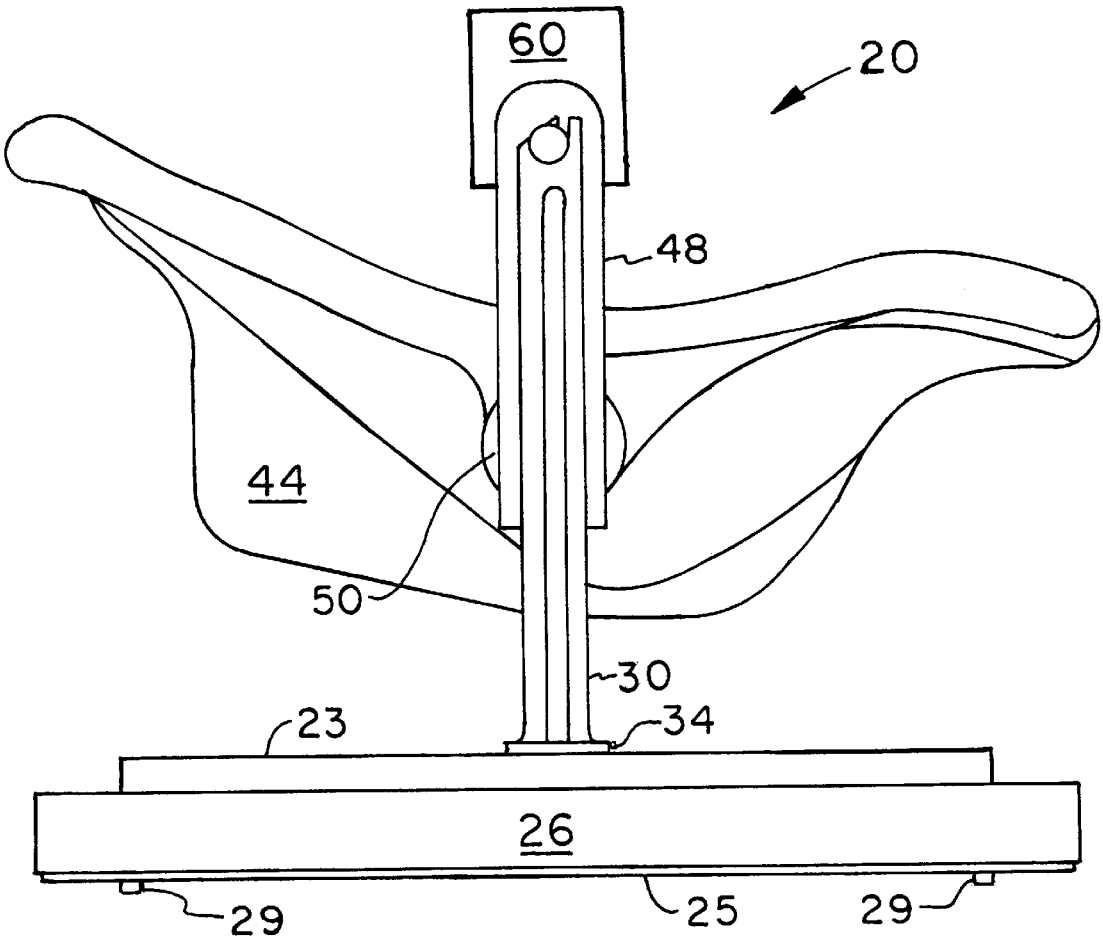
FIG. 2 is a side view of the first embodiment of swing.
Figure 3:
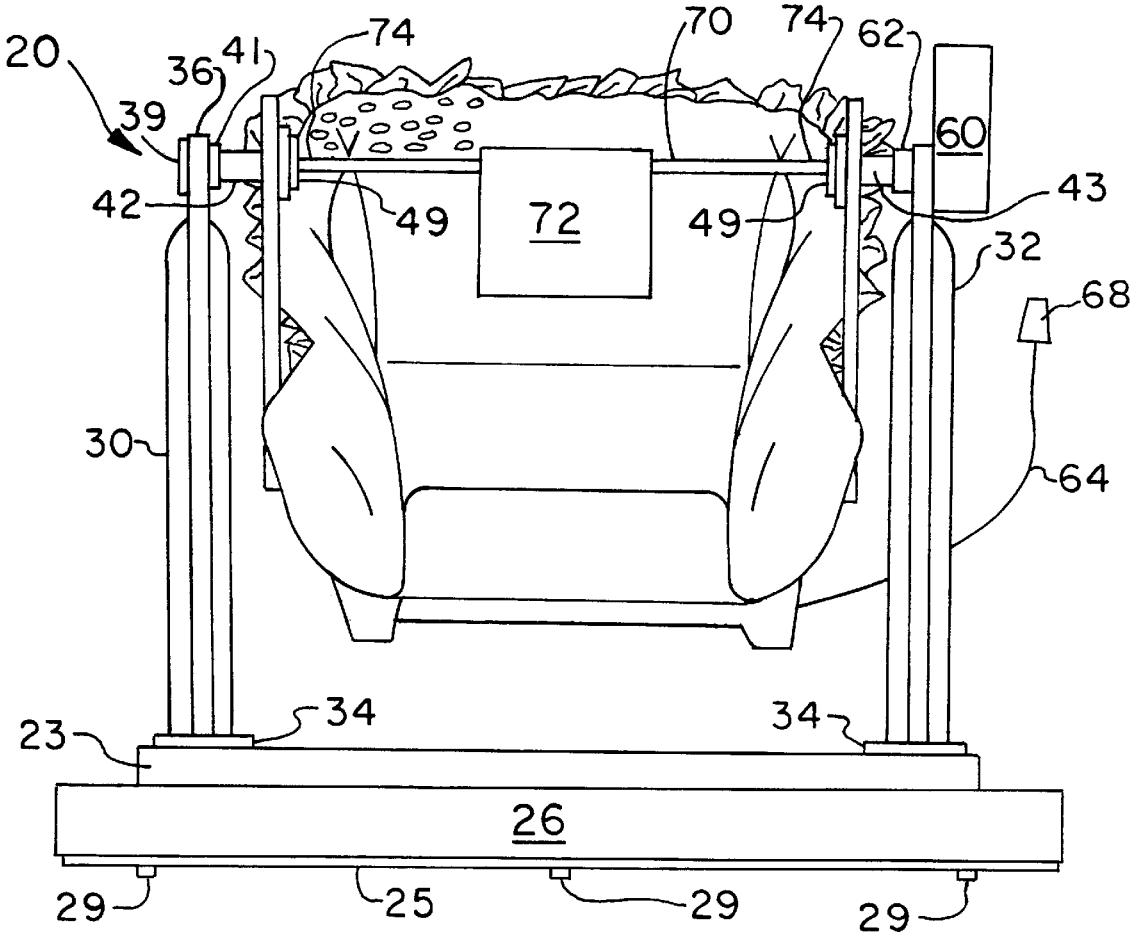
FIG. 3 is a front view of the first embodiment of swing.
Figure 4:
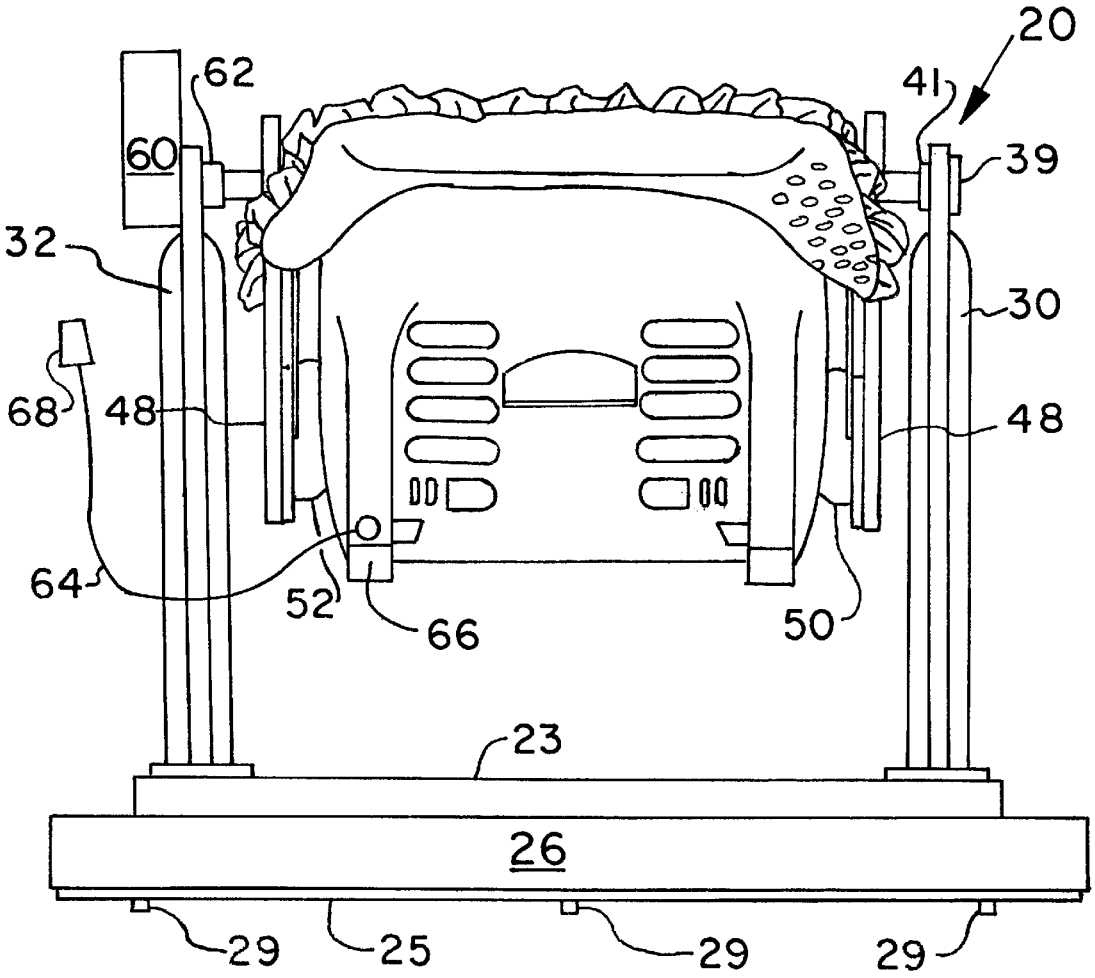
FIG. 4 is a back view of the first embodiment.
Figure 5:
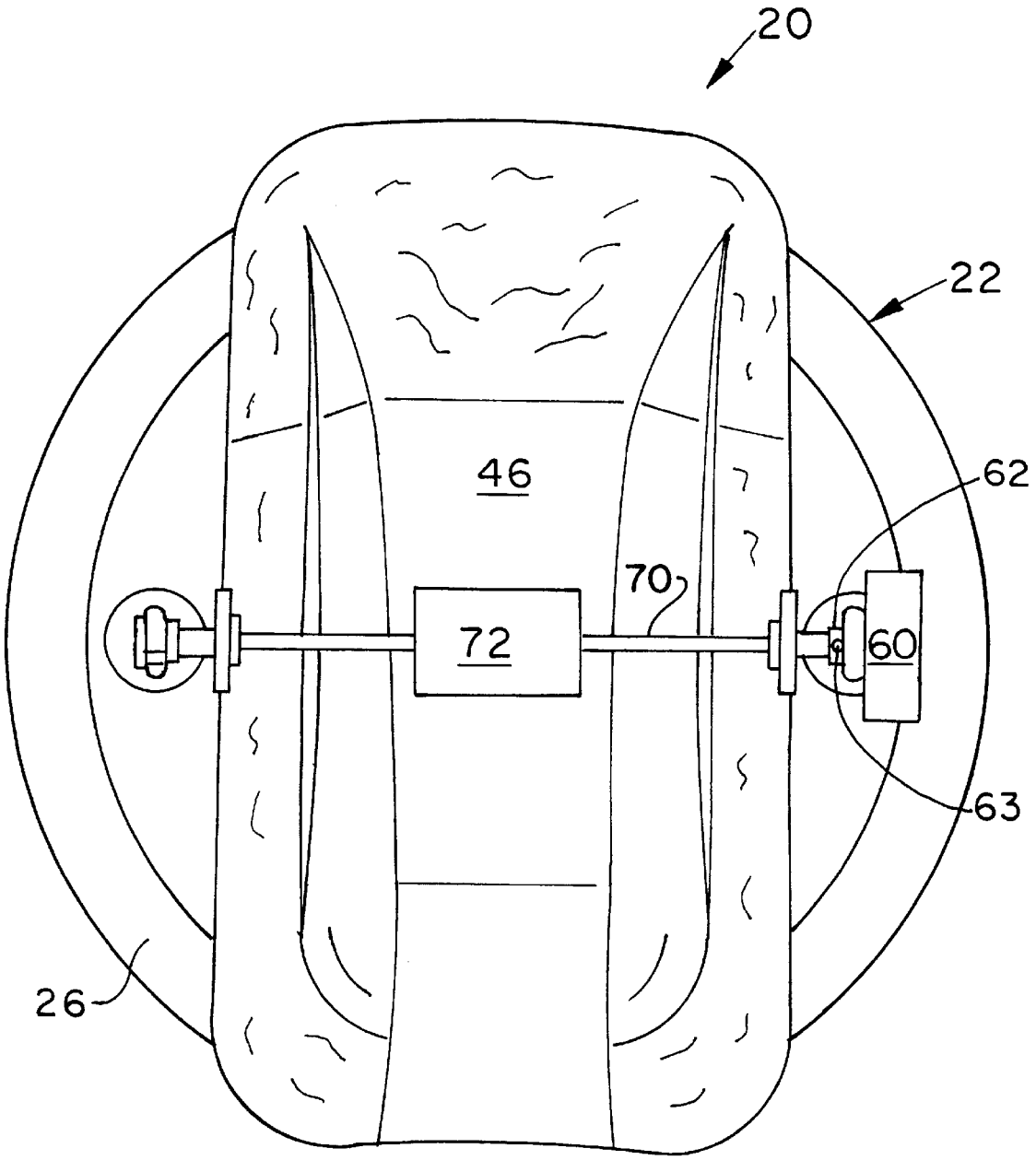
FIG. 5 is a top view of the first embodiment.

As shown in FIGS. 1 and 1A, legs 30, 32 have a cruciform cross section throughout most of their length, although other configurations (such as cylindrical with laterally projecting braces for engaging the base) can provide adequate horizontal and vertical stability. In this first embodiment, legs 30, 32 have an integral circular base 34 that may be attached to rotational base 26 in any conventional manner. Upper reach 36 of leg 30 may be equipped with a generally L-shaped notch 38 to permit stub axle 42 of seat member 40 to be readily removed so seat member 40 may serve a secondary function as a car seat or layette. Knob 39 on the end of stub axle 42 and a rib 41 on stub axle 42 capture the upper reach 36 of leg 30 and prevent relative lateral movement of seat member 40 relative to leg 30. The downward slope of L-shaped notch 38 will prevent undesired upward movement of stub axle 42 and only intentional lifting by the swing operator will disengage the stub axle 42 from notch 38. Stub axle 43 is received in sleeve 62 of oscillating motor 60 and secured thereto by set screw 63 (FIG. 5) that may engage in a recess in, or on a flat side of, (not shown) stub axle 43. Sleeve 62 extends through a bearing positioned in an upper reach 37 of leg 32. To remove seat member 40 from legs 30, 32, set screw 63 is loosened, stub axle 42 lifted clear of notch 38 and stub axle 43 removed from sleeve 62. To reinstall seat member 40, the process is reversed. It will be understood that manufacturing costs may again be shaved by eliminating this feature and simply rotationally securing both of stub axles 42, 43 to an upper portion of legs 30, 32, respectively.

Seat member 40 comprises an outer molded plastic shell 44 with a padded inner liner 46. A pair of arms 48 are attached to sides 50, 52 of shell 44 at 54 and have stub axles 39 extending outwardly therefrom The length of arms 48 between attachment points 54 and stub axles 42, 43 constitutes the radius arm for the oscillation of the swing seat member 40. It can be seen that this radius arm measured in inches rather than feet, will result in a gentle swinging motion. Further, since seat member 40 supports the infant in a semi-reclined position, the child need not be old enough to support the weight of its head and low-profile swing 20 can safely be used with children from new borne infants up through 12 months of age. Further, since the child's feet do not extend below the seat member, the swing need be no more than a few inches from the base. Such a low profile is extremely safe, tilt proof, and unachievable with conventional designs in which feet dangle below the seat. If swing assembly 20 is used with a new borne, cylindrical pillows, or the like, may be used to take up space along the sides and prevent the small baby from becoming skewed in seat member 40.

While motor 60 can be utilized to provide oscillatory motion, as an alternative or, in addition, a tether cord 64 can be attached to a rear portion 66 of seat member 40 and a handle 68 secured to the loose end thereof. The use of a musical device associated with motor 60, or separately therefrom, is within the scope of this disclosure. Further, a bar 70 extending between arms 48 can suspend a block 72, keys (not shown), or the like, for infants two months old and above to play with. The ends 74 of bar 70 are received in openings 49 in arms 48. A stop ring on a first end 74 and a spring engaging the other (neither shown) can be employed to properly position and retain bar 70 in a desired location.

The low-profile swing assembly 20 of the present invention has a base 22 that has a maximum dimension that exceeds the upward reach of support arms 30, 32. This geometry provides an extremely stable configuration that cannot be easily tipped. Further, the arms 48 that define the radius of swinging are comparatively short (vis a vis other swings) and hence, the swinging motion is very gentle. Also, the child's feet do not extend beyond the confines of the swing enabling a lower suspension than is possible with other designs. Lastly, the seat assembly 40 retains the infant in a semi-reclined position so, unlike the swings of the prior art, swing assembly 20 can be safely used with infants from new born up to 12 months of age. Low-profile swing assembly 20 is compact and light weight. It can easily be moved from place-to-place and picked up and placed in the trunk or back seat of a car to allow it to be transported to a friend's house so it may be utilized during a visit.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A low-profile swing for an infant comprising a) a stationary base element;

b) a rotational base element mounted on said stationary base element including means permitting rotation of said base element relative to said stationary base element about a vertical axis;

c) support legs extending upwardly from said rotational base element;

d) a seat for the infant rotationally mounted on said support legs for movement about a horizontal axis;

e) means for oscillating said seat relative to said support legs about the horizontal axis; whereby the rotational base element with the seat mounted thereon may be rotated about the vertical axis to provide the infant with a change of visibility.

2. The low-profile swing of claim 1 wherein said rotational base element can be turned relative to said stationary base element through 360°.

3. A low-profile swing assembly for an infant comprising a) a disk-shaped base member;

b) a plurality of support legs extending upward from said base member;

c) a seat for the infant supported solely by said support legs for movement about a transverse rotational axis extending between two of said plurality of support legs;

d) means for oscillating said seat relative to said base member and said support legs;

whereby an infant between the ages of newborn and 12 months may be placed in said seat and safely swung without fear of tipping.

4. The low-profile swing assembly of claim 3 wherein a maximum dimension of said disk-shaped element exceeds a maximum vertical extent of said support legs.

5. The low-profile swing assembly of claim 3 wherein said disk-shaped element comprises a stationary base portion and a rotatable base portion which sits upon said base portion permitting said swing to be rotated about a vertical axis through a 360° arc.

6. The low-profile swing assembly of claim 3 wherein said disk-shaped base member has a relatively small diameter.

7. The low-profile swing assembly of claim 3 wherein said disk-shaped base member has casters on a bottom thereof permitting said swing to be easily moved from place to place.

8. The low-profile assembly swing of claim 3 wherein said plurality of legs comprise two such legs which extend vertically upward from said base.

9. The low-profile swing assembly of claim 3 further comprising means to mount said seat upon said support legs permitting rapid removal thereof.

10. The low-profile swing assembly of claim 3 wherein said means for oscillating said seat comprises manual means for moving said seat.

11. The low-profile swing assembly of claim 10 wherein said manual means for oscillating said seat comprises a tether attached thereto facilitating swinging of said seat.

12. The low-profile swing assembly of claim 3 wherein said means for oscillating said seat comprises a motor assembly for repetitively oscillating said seat.

* * * * *